US007033251B2

(12) United States Patent
Elledge

(10) Patent No.: US 7,033,251 B2
(45) Date of Patent: Apr. 25, 2006

(54) CARRIER ASSEMBLIES, POLISHING MACHINES INCLUDING CARRIER ASSEMBLIES, AND METHODS FOR POLISHING MICRO-DEVICE WORKPIECES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 168 days.

(21) Appl. No.: 10/925,599

(22) Filed: Aug. 23, 2004

(65) Prior Publication Data

US 2005/0026544 A1 Feb. 3, 2005

Related U.S. Application Data

(62) Division of application No. 10/346,233, filed on Jan. 16, 2003.

(51) Int. Cl.
*B24B 7/22* (2006.01)

(52) U.S. Cl. ..... 451/41; 451/11; 451/288

(58) Field of Classification Search ..... 451/9, 451/11, 36, 41, 287, 288–290, 494, 550, 905
See application file for complete search history.

(56) References Cited

U.S. PATENT DOCUMENTS

| | | | |
|---|---|---|---|
| 5,036,015 | A | 7/1991 | Sandhu et al. |
| 5,069,002 | A | 12/1991 | Sandhu et al. |
| 5,081,796 | A | 1/1992 | Schultz |
| 5,222,875 | A | 6/1993 | Clark |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,413,941 | A | 5/1995 | Koos et al. |
| 5,421,769 | A | 6/1995 | Schultz et al. |
| 5,433,651 | A | 7/1995 | Lustig et al. |
| 5,439,551 | A | 8/1995 | Meikle et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |

(Continued)

OTHER PUBLICATIONS

U.S. Appl. No. 11/010,537, filed Dec. 13, 2004, Chandrasekaran.

Carlson, J. David, "What Makes a Good MR Fluid?" pp. 1–7, 8th Annual International Conference on Electrorheological (ER) Fluids and Magneto–rheological (MR) Suspensions, Nice, France, Jul. 9–13, 2001.

(Continued)

*Primary Examiner*—Lee D. Wilson
*Assistant Examiner*—Anthony Ojini
(74) *Attorney, Agent, or Firm*—Perkins Coie LLP

(57) ABSTRACT

Carrier assemblies, polishing machines with carrier assemblies, and methods for mechanical and/or chemical-mechanical polishing of micro-device workpieces are disclosed herein. In one embodiment, a carrier assembly includes a head having a chamber, a magnetic field source carried by the head, and a magnetic fluid in the chamber. The magnetic field source is configured to generate a magnetic field in the head. The magnetic fluid changes viscosity within the chamber under the influence of the magnetic field to exert a force against at least a portion of the micro-device workpieces. The magnetic fluid can be a magnetorheological fluid. The magnetic field source can include an electrically conductive coil and/or a magnet, such as an electromagnet. The carrier assembly can also include a fluid cell with a cavity to receive the magnetic fluid.

21 Claims, 6 Drawing Sheets

U.S. PATENT DOCUMENTS

| | | | | | |
|---|---|---|---|---|---|
| 5,609,718 | A | | 3/1997 | Meikle | |
| 5,618,381 | A | | 4/1997 | Doan et al. | |
| 5,618,447 | A | | 4/1997 | Sandhu | |
| 5,643,048 | A | | 7/1997 | Iyer | |
| 5,643,053 | A | * | 7/1997 | Shendon | 451/28 |
| 5,643,060 | A | | 7/1997 | Sandhu et al. | |
| 5,658,183 | A | | 8/1997 | Sandhu et al. | |
| 5,658,186 | A | | 8/1997 | Perrotto et al. | |
| 5,658,190 | A | | 8/1997 | Wright et al. | |
| 5,663,797 | A | | 9/1997 | Sandhu | |
| 5,664,988 | A | | 9/1997 | Stroupe et al. | |
| 5,668,061 | A | | 9/1997 | Herko et al. | |
| 5,679,065 | A | | 10/1997 | Henderson | |
| 5,681,215 | A | * | 10/1997 | Sherwood et al. | 451/388 |
| 5,700,180 | A | | 12/1997 | Sandhu et al. | |
| 5,702,292 | A | | 12/1997 | Brunelli et al. | |
| 5,730,642 | A | | 3/1998 | Sandhu et al. | |
| 5,738,562 | A | | 4/1998 | Doan et al. | |
| 5,747,386 | A | | 5/1998 | Moore | |
| 5,777,739 | A | | 7/1998 | Sandhu et al. | |
| 5,792,709 | A | | 8/1998 | Robinson et al. | |
| 5,795,495 | A | | 8/1998 | Meikle | |
| 5,798,302 | A | | 8/1998 | Hudson et al. | |
| 5,807,165 | A | | 9/1998 | Uzoh et al. | |
| 5,830,806 | A | | 11/1998 | Hudson et al. | |
| 5,836,807 | A | * | 11/1998 | Leach | 451/41 |
| 5,842,909 | A | | 12/1998 | Sandhu et al. | |
| 5,851,135 | A | | 12/1998 | Sandhu et al. | |
| 5,855,804 | A | | 1/1999 | Walker | |
| 5,868,896 | A | | 2/1999 | Robinson et al. | |
| 5,882,248 | A | | 3/1999 | Wright et al. | |
| 5,893,754 | A | | 4/1999 | Robinson et al. | |
| 5,895,550 | A | | 4/1999 | Andreas | |
| 5,910,846 | A | | 6/1999 | Sandhu | |
| 5,916,012 | A | | 6/1999 | Pant et al. | |
| 5,930,699 | A | | 7/1999 | Bhatia | |
| 5,931,718 | A | | 8/1999 | Komanduri et al. | |
| 5,931,719 | A | | 8/1999 | Nagahara et al. | |
| 5,934,980 | A | | 8/1999 | Koos et al. | |
| 5,936,733 | A | | 8/1999 | Sandhu et al. | |
| 5,945,347 | A | | 8/1999 | Wright | |
| 5,954,912 | A | | 9/1999 | Moore | |
| 5,967,030 | A | | 10/1999 | Blalock | |
| 5,972,792 | A | | 10/1999 | Hudson | |
| 5,980,363 | A | | 11/1999 | Meikle et al. | |
| 5,981,396 | A | | 11/1999 | Robinson et al. | |
| 5,994,224 | A | | 11/1999 | Sandhu et al. | |
| 5,997,384 | A | | 12/1999 | Blalock | |
| 6,007,408 | A | | 12/1999 | Sandhu | |
| 6,039,633 | A | | 3/2000 | Chopra | |
| 6,040,245 | A | | 3/2000 | Sandhu et al. | |
| 6,046,111 | A | | 4/2000 | Robinson | |
| 6,054,015 | A | | 4/2000 | Brunelli et al. | |
| 6,057,602 | A | | 5/2000 | Hudson et al. | |
| 6,059,638 | A | * | 5/2000 | Crevasse et al. | 451/41 |
| 6,066,030 | A | | 5/2000 | Uzoh | |
| 6,074,286 | A | | 6/2000 | Ball | |
| 6,083,085 | A | | 7/2000 | Lankford | |
| 6,108,092 | A | | 8/2000 | Sandhu | |
| 6,110,820 | A | | 8/2000 | Sandhu et al. | |
| 6,113,467 | A | * | 9/2000 | Koike | 451/41 |
| 6,116,988 | A | | 9/2000 | Ball | |
| 6,120,354 | A | | 9/2000 | Koos et al. | |
| 6,135,856 | A | | 10/2000 | Tjaden et al. | |
| 6,139,402 | A | | 10/2000 | Moore | |
| 6,143,123 | A | | 11/2000 | Robinson et al. | |
| 6,143,155 | A | | 11/2000 | Adams et al. | |
| 6,152,808 | A | | 11/2000 | Moore | |
| 6,176,992 | B1 | | 1/2001 | Talieh | |
| 6,180,525 | B1 | | 1/2001 | Morgan | |
| 6,184,571 | B1 | | 2/2001 | Moore | |
| 6,187,681 | B1 | | 2/2001 | Moore | |
| 6,190,494 | B1 | | 2/2001 | Dow | |
| 6,191,037 | B1 | | 2/2001 | Robinson et al. | |
| 6,191,864 | B1 | | 2/2001 | Sandhu | |
| 6,193,588 | B1 | | 2/2001 | Carlson et al. | |
| 6,200,901 | B1 | | 3/2001 | Hudson et al. | |
| 6,203,404 | B1 | | 3/2001 | Joslyn et al. | |
| 6,203,407 | B1 | | 3/2001 | Robinson | |
| 6,203,413 | B1 | | 3/2001 | Skrovan | |
| 6,206,754 | B1 | | 3/2001 | Moore | |
| 6,206,756 | B1 | | 3/2001 | Chopra et al. | |
| 6,206,769 | B1 | | 3/2001 | Walker | |
| 6,208,425 | B1 | | 3/2001 | Sandhu et al. | |
| 6,210,257 | B1 | | 4/2001 | Carlson | |
| 6,213,845 | B1 | | 4/2001 | Elledge | |
| 6,218,316 | B1 | | 4/2001 | Marsh | |
| 6,224,466 | B1 | | 5/2001 | Walker et al. | |
| 6,227,955 | B1 | | 5/2001 | Custer et al. | |
| 6,234,868 | B1 | * | 5/2001 | Easter et al. | 451/5 |
| 6,234,874 | B1 | | 5/2001 | Ball | |
| 6,234,877 | B1 | | 5/2001 | Koos et al. | |
| 6,234,878 | B1 | | 5/2001 | Moore | |
| 6,237,483 | B1 | | 5/2001 | Blalock | |
| 6,250,994 | B1 | | 6/2001 | Chopra et al. | |
| 6,251,785 | B1 | | 6/2001 | Wright | |
| 6,261,151 | B1 | | 7/2001 | Sandhu et al. | |
| 6,261,163 | B1 | | 7/2001 | Walker et al. | |
| 6,267,650 | B1 | | 7/2001 | Hembree | |
| 6,273,786 | B1 | | 8/2001 | Chopra et al. | |
| 6,273,796 | B1 | | 8/2001 | Moore | |
| 6,276,996 | B1 | | 8/2001 | Chopra | |
| 6,284,660 | B1 | | 9/2001 | Doan | |
| 6,287,879 | B1 | | 9/2001 | Gonzales et al. | |
| 6,290,572 | B1 | | 9/2001 | Hofmann | |
| 6,297,159 | B1 | | 10/2001 | Paton | |
| 6,301,006 | B1 | | 10/2001 | Doan | |
| 6,306,012 | B1 | | 10/2001 | Sabde | |
| 6,306,014 | B1 | | 10/2001 | Walker et al. | |
| 6,306,768 | B1 | | 10/2001 | Klein | |
| 6,312,558 | B1 | | 11/2001 | Moore | |
| 6,313,038 | B1 | | 11/2001 | Chopra et al. | |
| 6,319,420 | B1 | | 11/2001 | Dow | |
| 6,323,046 | B1 | | 11/2001 | Agarwal | |
| 6,328,632 | B1 | | 12/2001 | Chopra | |
| 6,331,488 | B1 | | 12/2001 | Doan et al. | |
| 6,338,667 | B1 | | 1/2002 | Sandhu et al. | |
| 6,350,180 | B1 | | 2/2002 | Southwick | |
| 6,350,691 | B1 | | 2/2002 | Lankford | |
| 6,352,466 | B1 | | 3/2002 | Moore | |
| 6,354,923 | B1 | | 3/2002 | Lankford | |
| 6,354,928 | B1 | * | 3/2002 | Crevasse et al. | 451/397 |
| 6,354,930 | B1 | | 3/2002 | Moore | |
| 6,358,122 | B1 | | 3/2002 | Sabde et al. | |
| 6,358,127 | B1 | | 3/2002 | Carlson et al. | |
| 6,358,129 | B1 | | 3/2002 | Dow | |
| 6,361,417 | B1 | | 3/2002 | Walker et al. | |
| 6,362,105 | B1 | | 3/2002 | Moore | |
| 6,364,746 | B1 | | 4/2002 | Moore | |
| 6,364,757 | B1 | | 4/2002 | Moore | |
| 6,368,190 | B1 | | 4/2002 | Easter et al. | |
| 6,368,193 | B1 | | 4/2002 | Carlson et al. | |
| 6,368,194 | B1 | | 4/2002 | Sharples et al. | |
| 6,368,197 | B1 | | 4/2002 | Elledge | |
| 6,376,381 | B1 | | 4/2002 | Sabde | |
| 6,387,289 | B1 | | 5/2002 | Wright | |
| 6,402,884 | B1 | | 6/2002 | Robinson et al. | |
| 6,402,978 | B1 | * | 6/2002 | Levin | 252/62.52 |
| 6,436,828 | B1 | * | 8/2002 | Chen et al. | 438/691 |
| 6,447,369 | B1 | | 9/2002 | Moore | |
| 6,482,077 | B1 | | 11/2002 | Doan et al. | |

| | | | |
|---|---|---|---|
| 6,579,799 | B1 | 6/2003 | Chopra et al. |
| 6,609,947 | B1 | 8/2003 | Moore |
| 2004/0038625 | A1 | 2/2004 | Elledge |
| 2004/0077292 | A1 | 4/2004 | Kim et al. |
| 2004/0142635 | A1 | 7/2004 | Chandrasekaran |
| 2004/0214514 | A1 | 10/2004 | Elledge |

OTHER PUBLICATIONS

Jolly, Mark R. et al., "Properties and Applications of Commercial Magnetorheological Fluids," 18 pages, SPIE 5th Annual International Symposium on Smart Structures and Materials, San Diego, California, Mar. 15, 1998.

Kondo, S. et al., "Abrasive–Free Polishing for Copper Damascene Interconnection," Journal of the Electrochemical Society, vol. 147, No. 10, pp. 3907–3913, 2000, The Electrochemical Society, Inc.

Lord Corporation, "Commercial Leader in MR Technology," 1 page, retrieved from the Internet on Jun. 14, 2002, <http://www.rheonetic.com>.

Lord Corporation, "Designing with MR Fluids," 5 pages, Engineering Note, Dec. 1999, Cary, North Carolina.

Lord Corporation, "Magnetic Circuit Design," 4 pages, Engineering Note, Nov. 1999, Cary North Carolina.

Lord Corporation, "Magneto–Rheological Fluids References," 3 pages, retrieved from the Internet on Jun. 14, 2002, <http://www.rheonetic.com/tech_library/mr_fluid.htm>.

Lord Materials Division, "What is the Difference Between MR and ER Fluid?" 6 pages, Cary, North Carolina, presented May 2002.

* cited by examiner

CARRIER ASSEMBLIES, POLISHING MACHINES INCLUDING CARRIER ASSEMBLIES, AND METHODS FOR POLISHING MICRO-DEVICE WORKPIECES

CROSS-REFERENCE TO RELATED APPLICATIONS

The present application is a divisional of U.S. patent application Ser. No. 10/346, 233, entitled "CARRIER ASSEMBLIES, POLISHING MACHINES INCLUDING CARRIER ASSEMBLIES, AND METHODS FOR POLISHING MICRO-DEVICE WORKPIECES." filed Jan. 16, 2003, and relates to co-pending U.S. patent application Ser. No. 10/226,571 filed on Aug. 23, 2002, both of which are herein incorporated by reference.

TECHNICAL FIELD

The present invention relates to carrier assemblies, polishing machines including carrier assemblies, and methods for mechanical and/or chemical-mechanical polishing of micro-device workpieces.

BACKGROUND

Mechanical and chemical-mechanical planarization processes (collectively, "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpieces 12 may be attached, or the workpieces 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpieces 12 (indicated by arrow J) and/or reciprocate the workpieces 12 back and forth (indicated by arrow 1).

The planarizing pad 40 and a planarizing solution 44 define a planarizing medium that mechanically and/or chemically-mechanically removes material from the surface of the micro-device workpieces 12. The planarizing solution 44 may be a conventional CMP slurry with abrasive particles and chemicals that etch and/or oxidize the surface of the micro-device workpieces 12, or the planarizing solution 44 may be a "clean" nonabrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpieces 12 with the CMP machine 10, the carrier head 30 presses the workpieces 12 facedown against the planarizing pad 40. More specifically, the carrier head 30 generally presses the micro-device workpieces 12 against the planarizing solution 44 on a planarizing surface 42 of the planarizing pad 40, and the platen 20 and/or the carrier head 30 moves to rub the workpieces 12 against the planarizing surface 42. As the micro-device workpieces 12 rubs against the planarizing surface 42, the planarizing medium removes material from the face of the workpieces 12.

The CMP process must consistently and accurately produce a uniformly planar surface on the workpieces to enable precise fabrication of circuits and photo-patterns. A nonuniform surface can result, for example, when material from one area of the workpieces is removed more quickly than material from another area during CMP processing. To compensate for the nonuniform removal of material, carrier heads have been developed with expandable interior and exterior bladders that exert downward forces on selected areas of the workpieces. These carrier heads, however, have several drawbacks. For example, the typical bladder has a curved edge that makes it difficult to exert a uniform downward force at the perimeter. Moreover, conventional bladders cover a fairly broad area of the workpieces, thus limiting the ability to localize the downward force on the workpieces. Furthermore, conventional bladders are often filled with compressible air that inhibits precise control of the downward force. In addition, carrier heads with multiple bladders form a complex system that is subject to significant downtime for repair and/or maintenance, causing a concomitant reduction in throughput.

SUMMARY

The present invention is directed toward carrier assemblies, polishing machines with carrier assemblies, and methods for mechanical and/or chemical-mechanical polishing of micro-device workpieces. One aspect of the invention is directed to a carrier assembly for retaining a micro-device workpieces during mechanical or chemical-mechanical polishing. In one embodiment, the carrier assembly includes a head having a chamber, a magnetic field source carried by the head, and a magnetic fluid in the chamber. The magnetic field source is configured to generate a magnetic field in the head. The magnetic fluid changes viscosity within the chamber under the influence of the magnetic field to exert a force against at least a portion of the micro-device workpieces. In one aspect of this embodiment, the magnetic fluid is a magnetorheological fluid. In another aspect of this embodiment, the magnetic field source can include an electrically conductive coil and/or a magnet, such as an electromagnet. The magnet can be one of a plurality of magnets arranged concentrically, in quadrants, in a grid, or in other configurations. The electrically conductive coil can also be one of a plurality of coils. In another aspect of this embodiment, the carrier assembly can include a bladder with a cavity to receive the magnetic fluid. The carrier assembly can also include a plurality of bladders that are arranged concentrically, in quadrants, in a grid, or in other configurations.

Another aspect of the invention is directed to polishing machines for mechanical or chemical-mechanical polishing of micro-device workpieces. In one embodiment, the machine includes a table having a support surface, a polishing pad carried by the support surface of the table, and a workpieces carrier assembly having a carrier head configured to retain a workpieces and a drive system coupled to the carrier head. The carrier head can include a chamber, a magnetic field source, a fluid cell in the chamber, and a magnetic fluid in the fluid cell. The magnetic field source can selectively generate a magnetic field in the chamber causing the viscosity of the magnetic fluid to increase and exert a desired force against at least a portion of the micro-device workpieces. The drive system is configured to move the carrier head to engage the workpieces with the polishing pad.

Another aspect of the invention is directed to a method for polishing a micro-device workpieces with a polishing machine having a carrier head and a polishing pad. In one embodiment, the method includes moving at least one of the carrier head and the polishing pad relative to the other to rub the micro-device workpieces against the polishing pad. The carrier head includes a chamber and a magnetorheological fluid in the chamber. The method further includes exerting a force against a back side of the workpieces by generating a magnetic field in the carrier head that changes the viscosity of the magnetorheological fluid in the chamber of the carrier head.

DETAILED DESCRIPTION

The present invention is directed to carrier assemblies, polishing machines including carrier assemblies, and methods for mechanical and/or chemical-mechanical polishing of micro-device workpieces. The term "micro-device workpieces" is used throughout to include substrates in or on which microelectronic devices, micro-mechanical devices, data storage elements, and other features are fabricated. For example, micro-device workpieces can be semiconductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–7D to provide a thorough understanding of certain embodiments of the invention. One skilled in the art, however, will understand that the present invention may have additional embodiments, or that other embodiments of the invention may be practiced without several of the specific features explained in the following description.

Figure 1:
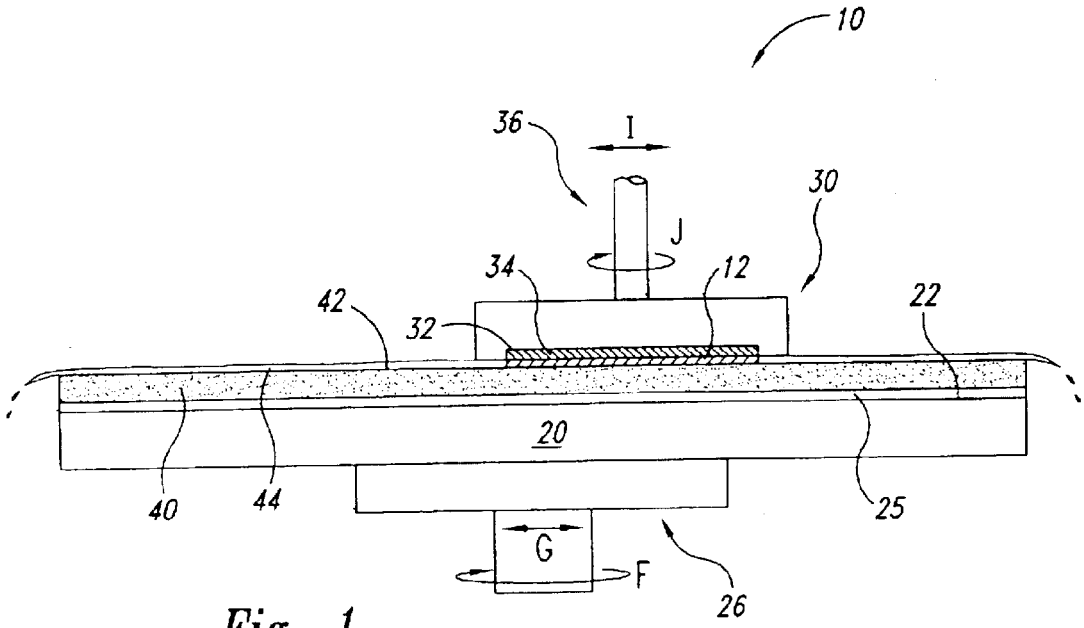
Fig. 1 (Prior Art)
FIG. 1 is a schematic cross-sectional side view of a portion of a rotary planarizing machine in accordance with the prior art.
Figure 2:
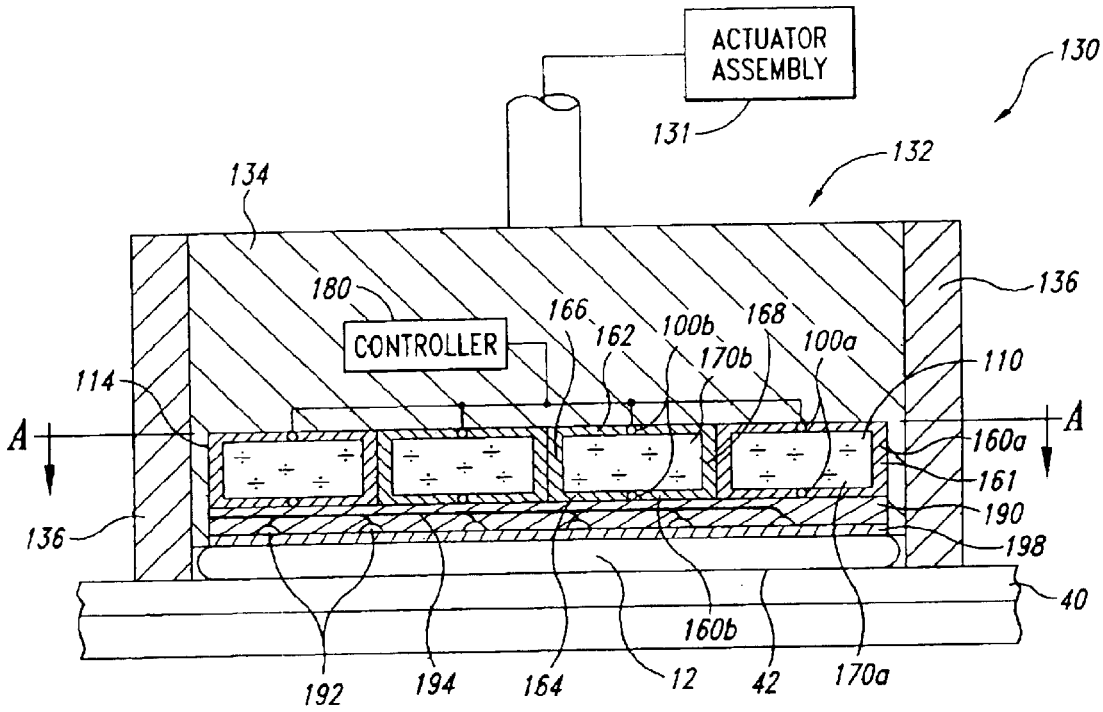
FIG. 2 is a schematic cross-sectional side view of a carrier assembly in accordance with one embodiment of the invention.

FIG. 2 is a schematic cross-sectional side view of a carrier assembly 130 in accordance with one embodiment of the invention. The carrier assembly 130 can be coupled to an actuator assembly 131 to move the workpieces 12 across the planarizing surface 42 of the planarizing pad 40. In the illustrated embodiment, the carrier assembly 130 includes a head 132 having a support member 134 and a retaining ring 136 coupled to the support member 134. The support member 134 can be an annular housing having an upper plate coupled to the actuator assembly 131. The retaining ring 136 extends around the support member 134 and projects toward the workpieces 12 below a bottom rim of the support member 134.

Figure 3:
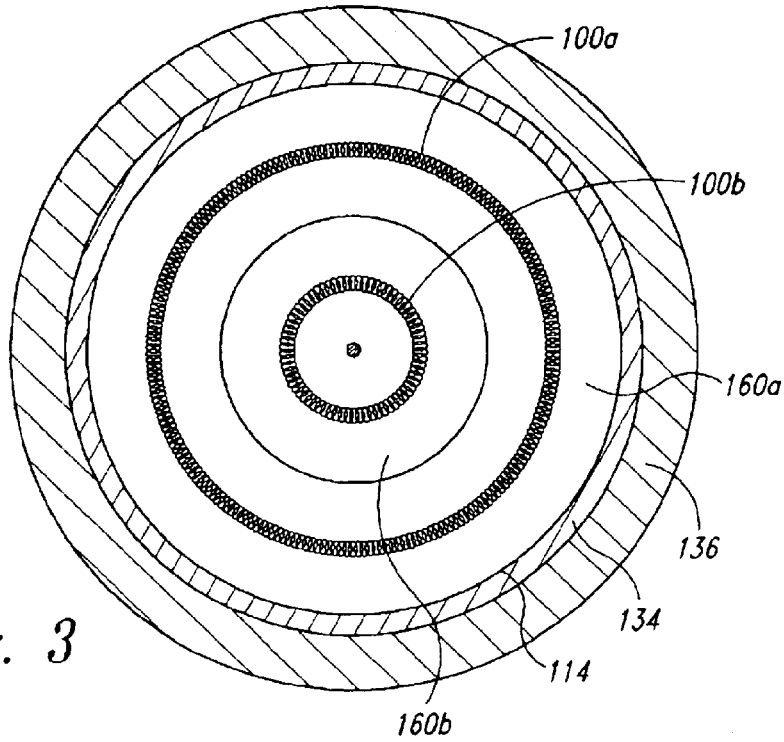
FIG. 3 is a schematic cross-sectional top view taken substantially along line A—A of FIG. 2.

In one aspect of this embodiment, the carrier assembly 130 includes a chamber 114 in the head 132, a first bladder 160*a* in the chamber 114, and a second bladder 160*b* in the chamber 114. The bladders 160 are fluid cells or fluid compartments that are suitable for containing fluid in discrete compartments within the head 132. FIG. 3 is a schematic cross-sectional top view taken substantially along line A—A of FIG. 2. The first and second bladders 160*a*–*b* each have an annular shape and are arranged concentrically with the first bladder 160*a* surrounding the second bladder 160*b*. In other embodiments, such as those described below with reference to FIGS. 5A–5C, the chamber 114 may contain a different number and/or configuration of bladders. In additional embodiments, the chamber 114 may not contain a bladder.

Referring to FIG. 2, each bladder 160 includes a membrane 161 and a cavity 170 (identified individually as 170*a*–*b*) defined by the membrane 161. The cavities 170 can contain a magnetic fluid 110, such as a magnetorheological fluid, that changes viscosity in response to a magnetic field. For example, in one embodiment, the viscosity of the magnetic fluid 110 can increase from a viscosity similar to that of motor oil to a viscosity of a nearly solid material depending upon the polarity and magnitude of a magnetic field applied to the magnetic fluid 110. In additional embodiments, the magnetic fluid 110 may experience a smaller change in viscosity in response to the magnetic field. In other embodiments, the viscosity of the magnetic fluid 110 may decrease in response to the magnetic field.

In another aspect of this embodiment, the carrier assembly 130 includes a first magnetic field source 100*a* and a second magnetic field source 100*b* that are each configured to generate magnetic fields in one of the cavities 170. For example, the first magnetic field source 100*a* can be carried by the first bladder 160*a* or the head 132 to selectively generate a magnetic field in the first cavity 170*a*, and the second magnetic field source 100*b* can be carried by the second bladder 160*b* or the head 132 to selectively generate a magnetic field in the second cavity 170*b*. In the illustrated embodiment, the magnetic field sources 100 each include a first electrically conductive coil embedded in the top surface 162 of the bladder 160 and a second electrically conductive coil embedded in the bottom surface 164 of the bladder 160. In other embodiments, a first side surface 166 and/or a second side surface 168 of each bladder 160 can carry the coils. In additional embodiments, the magnetic field sources 100 can include a different number of coils. In other embodiments, such as those described below with reference to FIGS. 6–7D, the carrier assembly 130 can include other magnetic field sources 100 to generate magnetic fields in the cavities 170.

In one aspect of the embodiment, a controller 180 is operatively coupled to the magnetic field sources 100 to selectively control the timing and strength of the magnetic fields in the cavities 170. The controller 180 can be an automatic process controller that adjusts the location and strength of the magnetic fields in real time based on the condition of the workpieces. The controller 180 can include an IC controller chip and a telematics controller.

The carrier assembly 130 can further include a flexible plate 190 and a flexible member 198 coupled to the flexible plate 190. The flexible plate 190 sealably encloses the bladders 160 in the chamber 114. In one aspect of this embodiment, the flexible plate 190 includes holes 192 and a vacuum line 194 coupled to the holes 192. The vacuum line 194 can be coupled to a vacuum source (not shown) to draw portions of the flexible member 198 into the holes 192, creating small suction cups across the back side of the workpieces 12 that hold the workpieces 12 to the flexible member 198. In other embodiments, the flexible plate 190 may not include the vacuum line 194 and the workpieces 12 can be secured to the carrier assembly 130 by another device. In the illustrated embodiment, the flexible member 198 is a flexible membrane. In other embodiments, the flexible member 198 can be a bladder or another device that prevents planarizing solution (not shown) from entering the chamber 114. In additional embodiments, the carrier assembly 130 may not include the flexible plate 190 and/or the flexible member 198.

Figure 4:
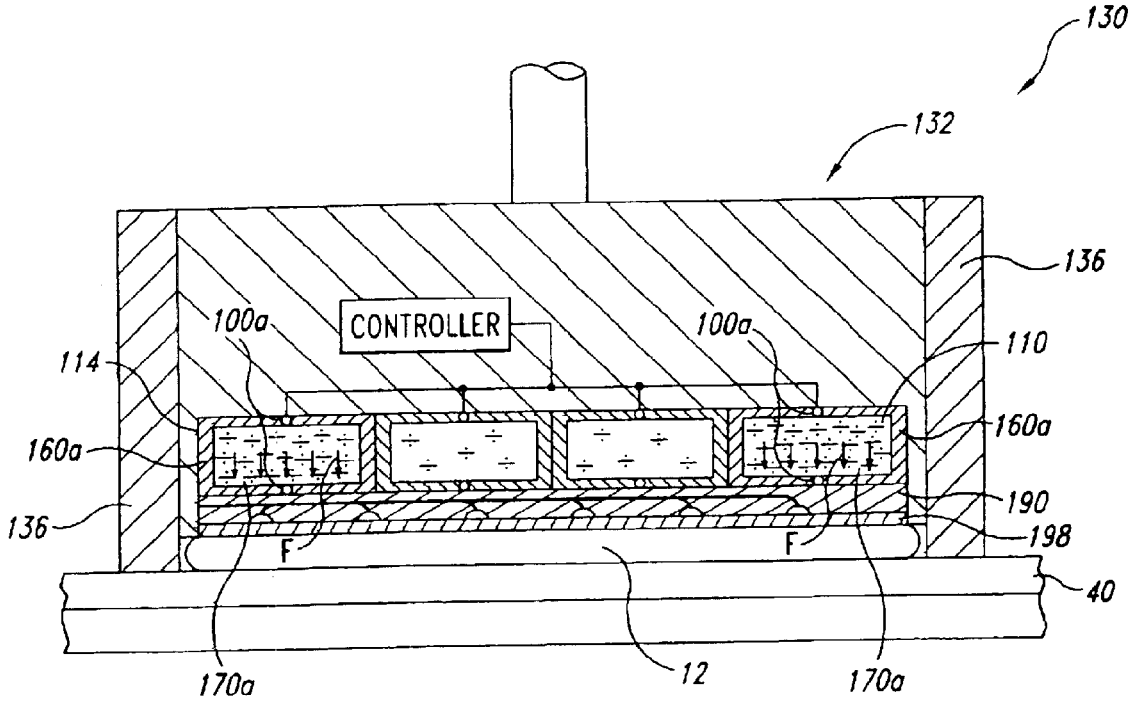
FIG. 4 is a schematic cross-sectional side view of the carrier assembly of FIG. 2 with a magnetic field applied in the first bladder.

FIG. 4 is a schematic cross-sectional side view of the carrier assembly 130 of FIG. 2 with a magnetic field applied in the first bladder 160*a*. In operation, the magnetic field sources 100 can selectively generate magnetic fields in the cavities 170 to exert discrete downward forces F on different areas of the workpieces 12. For example, in the illustrated embodiment, the first magnetic field source 100*a* generates a magnetic field in the first cavity 170*a*. The viscosity of the magnetic fluid 110 in the first bladder 160*a* increases in response to the magnetic field. The increased viscosity of the magnetic fluid 110 transmits a downward force F on the flexible plate 190 adjacent to the first bladder 160*a*. The force F flexes the flexible plate 190 and the flexible member 198 downward and is accordingly applied to a perimeter region of the workpieces 12.

The magnitude of the force F is determined by the strength of the magnetic field, the type of magnetic fluid 110, the amount of magnetic fluid 110 in the bladder 160, and other factors. The greater the magnetic field strength, the greater the magnitude of the force F. The location of the force F and the area over which the force F is applied to the workpieces 12 are determined by the location and size of the magnetic field and the bladder 160. In other embodiments, a plurality of discrete forces can be applied concurrently to the workpieces 12. As discussed above, the magnetic field sources 100 can generate magnetic fields and the associated forces in real time based on the profile of the workpieces. Furthermore, if previously polished workpieces have areas with consistent high points, the carrier assembly 130 can exert a greater downward force in those areas compared to low points to create a more uniformly planar surface on the workpieces.

Figure 5A:
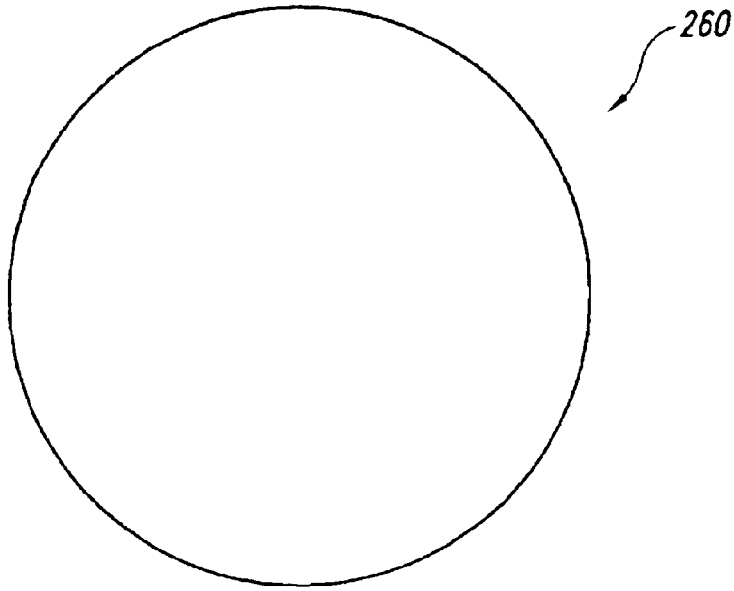
FIG. 5A is a schematic top view of a single circular bladder in accordance with another embodiment of the invention.
Figure 5B:
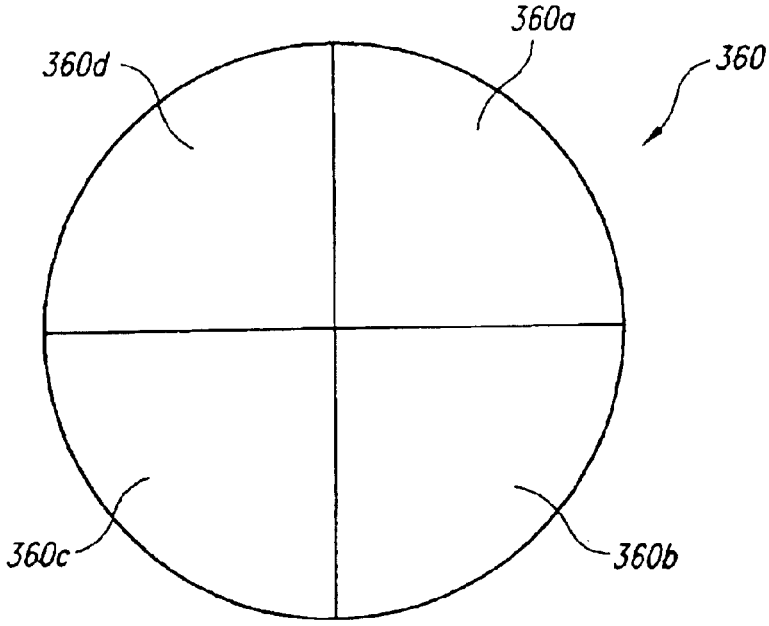
FIG. 5B is a schematic top view of a plurality of bladders arranged in quadrants in accordance with another embodiment of the invention.
Figure 5C:
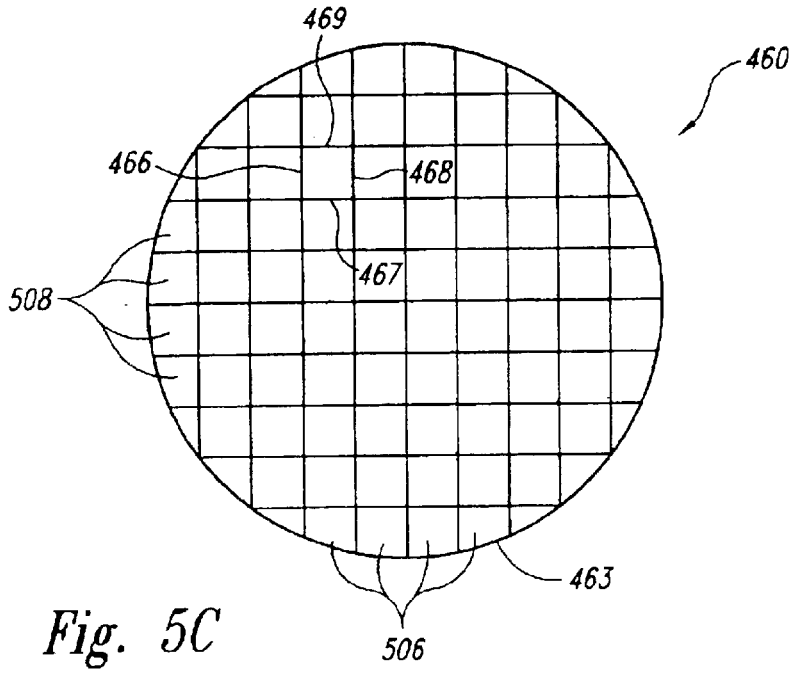
FIG. 5C is a schematic top view of a plurality of bladders arranged in a grid in accordance with another embodiment of the invention.

FIGS. 5A–5C are schematic top views of various bladders for use with carrier assemblies in accordance with additional embodiments of the invention. For example, FIG. 5A illustrates a single circular bladder 260 having a cavity to receive a magnetic fluid. FIG. 5B is a schematic top view of a plurality of bladders 360 (identified individually as 360*a*–*d*) in accordance with another embodiment of the invention. The bladders 360 include a first bladder 360*a*, a second bladder 360*b*, a third bladder 360*c*, and a fourth bladder 360*d* forming quadrants of a circle. Each bladder 360 has a separate cavity to receive a magnetic fluid.

FIG. 5C is a schematic top view of a plurality of bladders 460 in accordance with another embodiment of the invention. The bladders 460 are arranged in a grid with columns 506 and rows 508. Each bladder 460 has a first side 466, a second side 467, a third side 468, and a fourth side 469, and each bladder 460 has a cavity to receive a magnetic fluid. The first side 466 of one bladder 460 can contact or be spaced apart from the third side 468 of an adjacent bladder 460. In the illustrated embodiment, the bladders 460 proximate to the perimeter have a curved side 463 corresponding to the curvature of the chamber 114 (FIG. 2) in the carrier assembly 130 (FIG. 2). In other embodiments, the bladders can have other configurations, such as a hexagonal or pentagonal shape.

Figure 6:
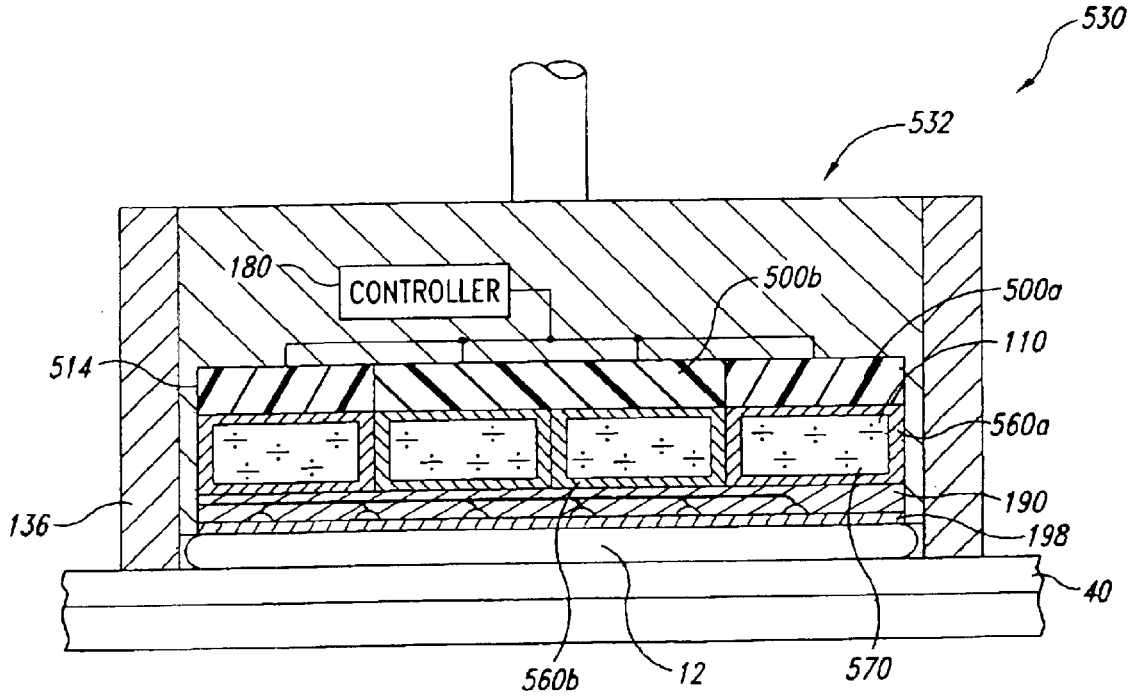
FIG. 6 is a schematic cross-sectional side view of a carrier assembly in accordance with another embodiment of the invention.

FIG. 6 is a schematic cross-sectional side view of a carrier assembly 530 in accordance with another embodiment of the invention. The carrier assembly 530 is similar to the carrier assembly 130 described above with reference to FIG. 2. For example, the carrier assembly 530 includes a head 532, a chamber 514 in the head 532, a first bladder 560*a* in the chamber 514, and a second bladder 560*b* in the chamber 514. The first and second bladders 560*a*–*b* each include a cavity 570 containing the magnetic fluid 110. The carrier assembly 530 also includes a first magnetic field source 500*a* carried by the first bladder 560*a* and a second magnetic field source 500*b* carried by the second bladder 560*b*. In one aspect of this embodiment, the first magnetic field source 500*a* has an annular shape and surrounds the second magnetic field source 500*b*. Each magnetic field source 500 can be a permanent magnet, an electromagnet, an electrical coil, or any other device that creates a magnetic field in the cavities 570. In additional embodiments, the magnetic field sources can be a single source or a plurality of sources with various configurations, such as those discussed below with reference to FIGS. 7A–7D. In other embodiments, the magnetic field sources can be external to the chamber 514, such as being positioned in or above the head 532.

Figure 7A:
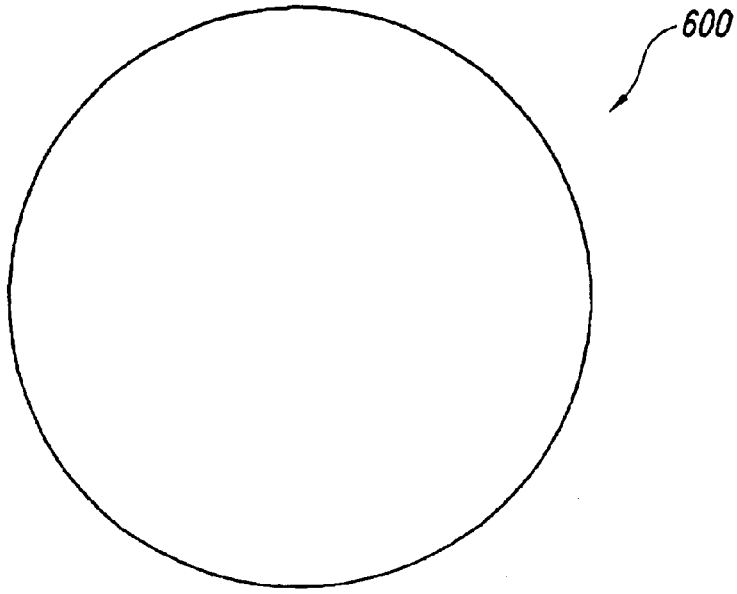
FIG. 7A is a schematic top view of a single circular magnetic field source in accordance with one embodiment of the invention.
Figure 7B:
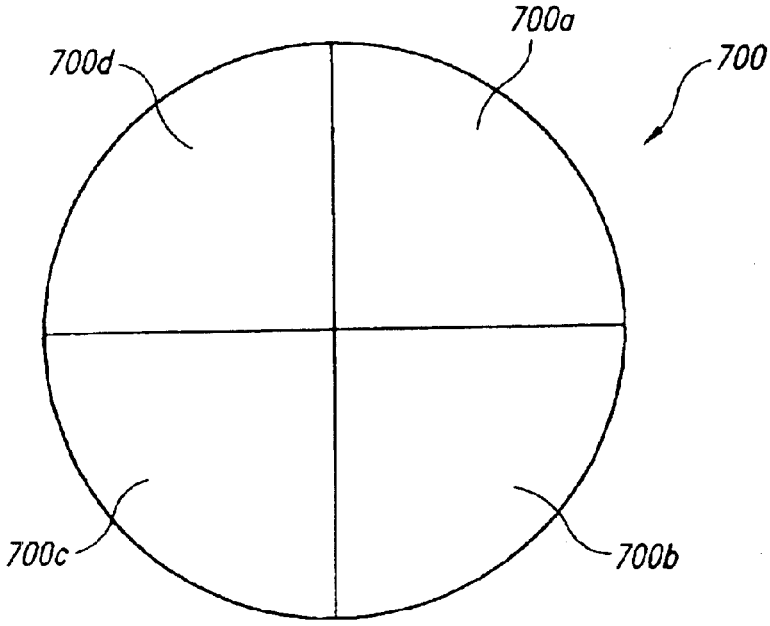
FIG. 7B is a schematic top view of a plurality of magnetic field sources arranged in quadrants in accordance with another embodiment of the invention.
Figure 7C:
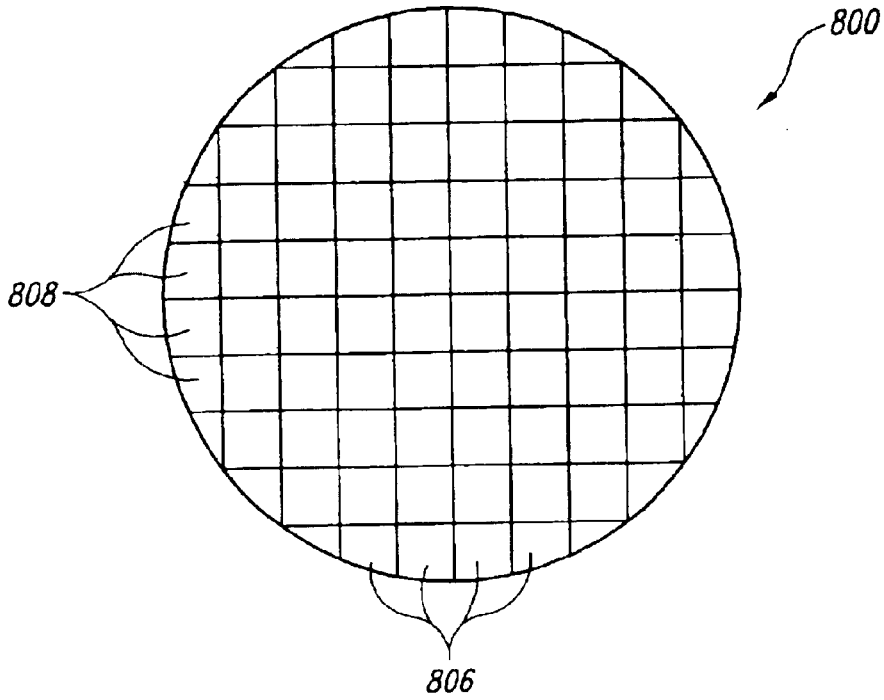
FIG. 7C is a schematic top view of a plurality of magnetic field sources arranged in a grid in accordance with another embodiment of the invention.
Figure 7D:
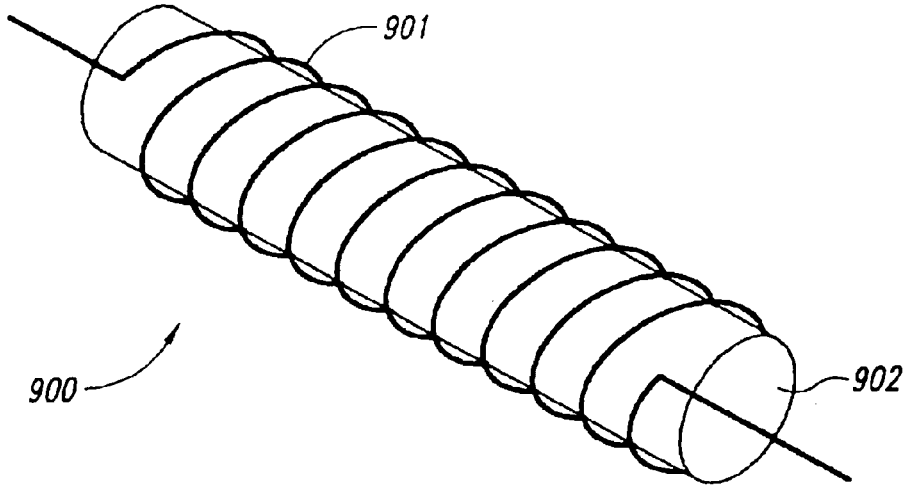
FIG. 7D is a schematic isometric view of a magnetic field source including an electrical coil in accordance with another embodiment of the invention.

FIGS. 7A–7D are schematic views of various magnetic field sources for use with carrier assemblies in accordance with additional embodiments of the invention. For example, FIG. 7A illustrates a single circular magnetic field source 600, such as a permanent magnet or electromagnet. FIG. 7B is a schematic top view of four magnetic field sources (identified individually as 700*a*–*d*) arranged in quadrants. Each magnetic field source 700 can selectively generate a magnetic field. FIG. 7C is a schematic top view of a plurality of magnetic field sources 800 arranged in a grid with columns 806 and rows 808. In other embodiments, the size of each magnetic field source 800 can be decreased to increase the resolution of the magnetic fields. FIG. 7D is a schematic isometric view of a magnetic field source 900 including an electrically conductive coil 901. The magnetic field source 900 can have an air core, or the coil 901 can be wound around an inductive core 902 to form a magnetic field having a higher flux density. In other embodiments, magnetic field sources can have other configurations.

One advantage of the illustrated embodiments is the ability to apply highly localized forces to the workpieces with a quick response time. This highly localized force control enables the CMP process to consistently and accurately produce a uniformly planar surface on the workpieces. Moreover, the localized forces can be changed in situ during a CMP cycle. For example, a polishing machine having one of the illustrated carrier assemblies can monitor the planarizing rates and/or the surface of the workpieces and adjust accordingly the magnitude and position of the forces applied to the workpieces to produce a planar surface. Another advantage of the illustrated carrier assemblies is that they are simpler than existing systems and, consequently, reduce downtime for maintenance and/or repair and create greater throughput.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method for polishing a micro-device workpieces with a polishing machine having a carrier head and a polishing pad, the method comprising:

moving at least one of the carrier head and the polishing pad relative to the other to rub the micro-device workpieces against the polishing pad, wherein the carrier head comprises a chamber and a magnetorheological fluid in the chamber; and exerting a force against a back side of the micro-device workpieces by generating a magnetic field in the carrier head that changes the viscosity of the magnetorheological fluid in the chamber of the carrier head.

2. The method of claim 1 wherein exerting the force against the back side of the micro-device workpiece comprises providing power to an electrically conductive coil to generate the magnetic field.

3. The method of claim 1 wherein exerting the force against the back side of the micro-device workpiece comprises generating the magnetic field with a magnet.

4. The method of claim 1 wherein exerting the force against the back side of the micro-device workpiece comprises increasing the viscosity of the magnetorheological fluid in a fluid cell within the chamber in response to the magnetic field.

5. The method of claim 1 wherein exerting the force against the back side of the micro-device workpiece comprises generating the magnetic field in a fluid cell within the chamber of the carrier head to exert the force against a portion of the back side of the micro-device workpiece adjacent to the fluid cell.

6. The method of claim 1 wherein:

the chamber comprises first fluid cell and a second fluid cell having a generally annular shape, the first and second fluid cells being arranged concentrically; and exerting the force against the back side of the workpiece comprises changing the viscosity of the magnetorheological fluid in the first and/or second fluid cell.

7. The method of claim 1 wherein:

the chamber comprises plurality of fluid cells arranged in quadrants; and exerting the force against the back side of the workpiece comprises changing the viscosity of the magnetorheological fluid in at least one of the fluid cells.

8. The method of claim 1 wherein:

the chamber comprises plurality of fluid cells arranged in a grid; and exerting the force against the back side of the workpiece comprises changing the viscosity of the magnetorheological fluid in at least one of the fluid cells.

9. The method of claim 1 wherein:

the carrier head further comprises a plurality of magnets arranged concentrically; and exerting the force against the back side of the workpiece comprises generating the magnetic field with at least one of the magnets.

10. The method of claim 1 wherein:

the carrier head further comprises a plurality of magnets arranged in a grid; and exerting the force against the back side of the workpiece comprises generating the magnetic field with at least one of the magnets.

11. The method of claim 1 wherein:

the carrier head further comprises a plurality of magnets arranged in quadrants; and exerting the force against the back side of the workpiece comprises generating the magnetic field with at least one of the magnets.

12. The method of claim 1 wherein:

the carrier head further comprises a bladder, a first electrically conductive coil, and a second electrically conductive coil, the bladder having a first side carrying the first coil and a second side carrying the second coil; and exerting the force against the back side of the workpiece comprises generating the magnetic field with at least one of the first and/or second coil.

13. A method for polishing a micro-device workpiece, comprising:

moving at least one of a carrier head and a polishing pad relative to the other to rub the micro-device workpiece against the polishing pad, wherein the carrier head comprises a magnetic field source, a chamber, a fluid in the chamber, and a flexible member positioned proximate to the micro-device workpiece; and applying pressure against a back side of the micro-device workpiece by causing the magnetic field source to generate a magnetic field that increases the viscosity of the fluid in the chamber.

14. The method of claim 13 wherein applying pressure against the back side of the micro-device workpiece comprises increasing the viscosity of a magnetorheological fluid in the chamber.

15. The method of claim 13 wherein applying pressure against the back side of the micro-device workpiece comprises providing power to an electrically conductive coil to generate the magnetic field.

16. The method of claim 13 wherein applying pressure against the back side of the micro-device workpiece comprises generating the magnetic field with a magnet.

17. The method of claim 13 wherein applying pressure against the back side of the micro-device workpiece comprises generating the magnetic field in a fluid cell within the chamber of the carrier head to exert the force against a portion of the back side of the micro-device workpiece adjacent to the fluid cell.

18. The method of claim 13 wherein:

the chamber comprises first fluid cell and a second fluid cell having a generally annular shape, the first and second fluid cells being arranged concentrically; and applying pressure against the back side of the workpiece comprises changing the viscosity of a magnetorheological fluid in the first and/or second fluid cell.

19. The method of claim 13 wherein:

the magnetic field source comprises a plurality of magnets arranged concentrically; and applying pressure against the back side of the workpiece comprises generating the magnetic field with at least one of the magnets.

20. The method of claim 13 wherein:

the magnetic field source comprises a plurality of magnets arranged in a grid; and applying pressure against the back side of the workpiece comprises generating the magnetic field with at least one of the magnets.

21. The method of claim 13 wherein:

the magnetic field source comprises a first electrically conductive coil and a second electrically conductive coil, the carrier head further comprises a bladder, the bladder having a first side carrying the first coil and a second side carrying the second coil; and applying pressure against the back side of the workpiece comprises generating the magnetic field with at least one of the first and/or second coils.

* * * * *